US008977149B2

(12) United States Patent
Mochizuki

(10) Patent No.: US 8,977,149 B2
(45) Date of Patent: Mar. 10, 2015

(54) IMAGE FORMING APPARATUS

(71) Applicant: Canon Kabushiki Kaisha, Tokyo (JP)

(72) Inventor: Jun Mochizuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 13/741,680

(22) Filed: Jan. 15, 2013

(65) Prior Publication Data

US 2013/0183047 A1 Jul. 18, 2013

(30) Foreign Application Priority Data

Jan. 18, 2012 (JP) ..... 2012-008206

(51) Int. Cl.
*G03G 15/00* (2006.01)

(52) U.S. Cl.
CPC ..... *G03G 15/5062* (2013.01); *G03G 15/6561* (2013.01)
USPC ..... 399/49; 399/396

(58) Field of Classification Search
CPC ..... G03G 15/1605; G03G 15/1615; G03G 2215/00599; G03G 15/5062
USPC ..... 399/49, 66, 396
See application file for complete search history.

(56) References Cited

U.S. PATENT DOCUMENTS

2008/0240821 A1* 10/2008 Shoji et al. ..... 399/395
2010/0303490 A1* 12/2010 Ozeki ..... 399/49

FOREIGN PATENT DOCUMENTS

JP 8-240954 A 9/1996

* cited by examiner

*Primary Examiner* — Gregory H Curran
(74) *Attorney, Agent, or Firm* — Canon USA Inc IP Division

(57) ABSTRACT

An image forming apparatus including an image forming unit configured to form an image on the image bearing member, a transfer unit configured to transfer the image on the image bearing member to a recording material, a conveyance unit configured to convey the recording material to the transfer unit, a controller configured to form a test sheet by causing a test image to be formed on the image bearing member such that the test image has a predetermined density and causing the test image to be transferred to the recording material, and a determination unit configured to determine a conveyance speed of the recording material such that a density difference between a density of the test image on the test sheet and the predetermined density is less than or equal to a threshold value.

16 Claims, 11 Drawing Sheets

IMAGE FORMING APPARATUS

BACKGROUND OF THE INVENTION

1. Field of the Invention

The present disclosure relates to an image forming apparatus for controlling a speed of a drive system for conveying a recording material.

2. Description of the Related Art

Among electrophotographic image forming apparatuses, there is an apparatus having a configuration in which a toner image formed with toner according to image data is borne on an intermediate transfer member, and the toner image on the intermediate transfer member is conveyed to a transfer unit by driving the intermediate transfer member. In this configuration, a recording material such as a sheet is supplied to be brought into contact with the toner image on the intermediate transfer member at timing when the toner image on the intermediate transfer member reaches the transfer unit. In the transfer unit, a voltage difference is generated between the intermediate transfer member and the recording material, so that the toner image on the intermediate transfer member is transferred to the recording material. The recording material with the toner image transferred by the transfer unit is conveyed to a fixing unit. Then, the toner image on the recording material is fixed by heat and pressure of the fixing unit and discharged from the image forming apparatus.

In the image forming apparatus having such a configuration, a pair of registration rollers is disposed to stop the recording material in a predetermined position before the toner image on the intermediate transfer member reaches the transfer unit, and supply the recording material at timing when the toner image on the intermediate transfer member reaches the transfer unit.

Herein, in an area near the transfer unit in a direction to which the recording material is conveyed, a force causing the toner on the intermediate transfer member to move to the recording material is generated by influence of a transfer electric field based on the potential difference between the intermediate transfer member and the recording material. Consequently, even near the transfer unit, the toner on the intermediate transfer member is transferred to the recording material. However, the force causing the toner to move to a recording material side continues to decrease near the transfer unit while the toner on the intermediate transfer member is moving to the recording material from the intermediate transfer member. Such a decrease in the force causes the toner to adhere to an area on the recording material, the area being to which toner is not originally supposed to adhere. This becomes more noticeable as a gap between the recording material and the intermediate transfer member becomes wider near an upstream side of the transfer unit in a conveyance direction of the recording material, thereby causing deterioration in quality of an image formed by the image forming apparatus.

Japanese Patent Application Laid-Open No. 8-240954 discusses the transfer of a toner image on an intermediate transfer member to a recording material in a state that the recording material being conveyed to a transfer unit is slightly distorted toward the side of the intermediate transfer member. Specifically, a speed of conveying the recording material by registration rollers is set slightly higher than that by the intermediate transfer member in the transfer unit, so that a gap between the recording material and the intermediate transfer member is narrowed on an upstream side relative to the transfer unit in the conveyance direction of the recording material.

However, since an outer diameter of the registration roller changes due to a change in humidity and temperature of environment where an image forming apparatus is placed, there are cases where a speed of conveying the recording material by the registration rollers fails to reach a target speed. For example, when an outer diameter of the registration roller increases, a speed of conveying the recording material by the registration roller becomes higher than a target speed. Thus, if a conveyance speed of the recording material becomes higher than a speed of the intermediate transfer member to be driven, an image to be formed on the recording material has an area having a higher density than a target density.

Such a problem occurs when the speed of conveying the recording material by the registration roller exceeds the target speed, and becomes higher than the driven speed of the intermediate transfer member. This higher speed causes an increase in a distortion amount of the recording material, thereby damaging a toner image on the intermediate transfer member by the recording material. In other words, when a distortion amount of a recording material becomes larger than a predetermined amount while the recording material is passing a transfer unit, a surface of the recording material is repeatedly brought into contact with and separated from a toner image on an intermediate transfer member. The toner image on the intermediate transfer member can be damaged by being brought into contact with the surface of the recording material for many times.

Consequently, when the toner image damaged by being brought into contact with the recording material is transferred to the recording material, a print product having a low quality image is formed.

SUMMARY OF THE INVENTION

The present disclosure is directed to an image forming apparatus for suppressing a situation in which a recording material to pass a transfer unit is brought into contact with a toner image having not yet reached the transfer unit.

According to an aspect of the present disclosure, an image forming apparatus includes an image bearing member configured to bear and convey an image, an image forming unit configured to form the image on the image bearing member, a transfer unit configured to transfer the image formed on the image bearing member by the image forming unit to a recording material, a conveyance unit configured to convey the recording material to the transfer unit, a controller configured to form a test sheet by causing the image forming unit to form a test image on the image bearing member such that the test image has a predetermined density and causing the transfer unit to transfer the test image on the image bearing member to the recording material conveyed by the conveyance unit, and a determination unit configured to determine a conveyance speed of the recording material to be conveyed to the transfer unit by the conveyance unit such that a density difference between a density of the test image to be formed on the test sheet and the predetermined density is less than or equal to a threshold value.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles disclosed herein.

DESCRIPTION OF THE EMBODIMENTS

Various exemplary embodiments, features, and aspects of the disclosure will be described in detail below with reference to the drawings.

Figure 1:
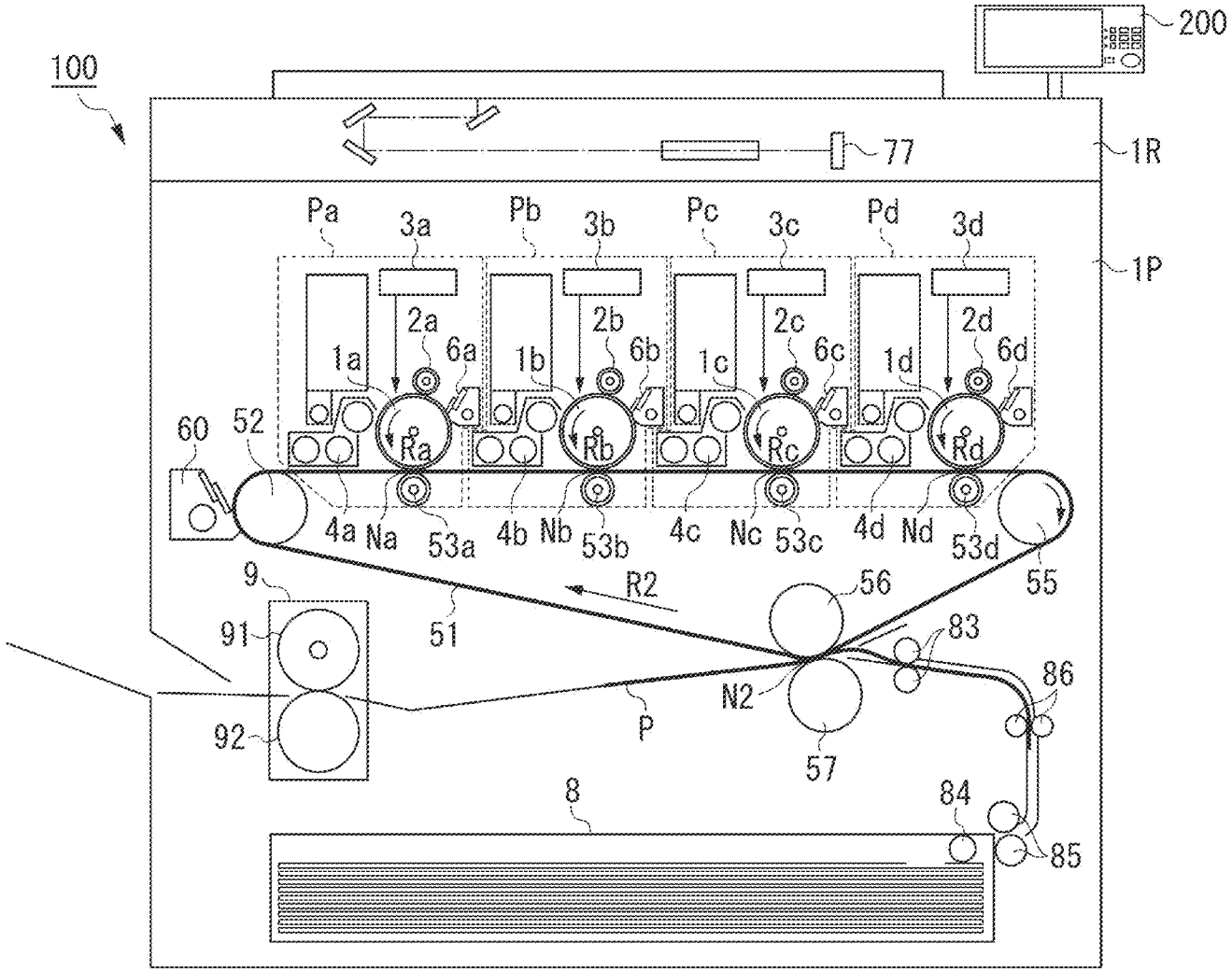
FIG. 1 is a schematic diagram illustrating a main part of an image forming apparatus according to a first exemplary embodiment.

A first exemplary embodiment of the present disclosure is described with reference to FIG. 1 through FIG. 8. FIG. 1 is a schematic cross-sectional view illustrating an image forming apparatus 100 of the present exemplary embodiment. The image forming apparatus 100 includes a reader unit 1R and a printer unit 1P.

The printer unit 1P includes four image forming units Pa, Pb, Pc, and Pd for forming toner images of respective color components. The image forming unit Pa forms a toner image of yellow. The image forming units Pb, PC, and Pd form toner images of magenta, cyan, and black, respectively.

The image forming unit Pa includes a photosensitive drum 1*a* for bearing a toner image of a yellow component, a charging unit 2*a* for charging the photosensitive drum 1*a*, and an exposure device 3*a* for exposing the photosensitive drum 1*a* to light to form an electrostatic latent image corresponding to the yellow component on the photosensitive drum 1*a*. Moreover, the image forming unit Pa includes a developing unit 4*a* and a primary transfer roller 53*a*. The developing unit 4*a* visualizes the electrostatic latent image formed on the photosensitive drum 1*a* as a toner image using developer including toner. The primary transfer roller 53*a* transfers the toner image on the photosensitive drum 1*a* to an intermediate transfer belt 51.

The image forming unit Pa also includes a drum cleaner 6*a* for removing toner remained on the photosensitive drum 1*a* after the toner image is transferred. Since a configuration of each of the image forming units Pb, Pc, and Pd is similar to that of the image forming unit Pa forming a toner image of yellow, a description thereof is omitted.

The intermediate transfer belt 51 serves as an image bearing member for bearing a toner image. The intermediate transfer belt 51 bears toner images of color components formed by the respective image forming units Pa, Pb, Pc, and Pd by overlaying each of these images one on another, thereby forming a full-color toner image. A roller 56 and are disposed near the intermediate transfer belt 51. The roller 56 and the secondary transfer roller 57 transfer a toner image on the intermediate transfer belt 51 to a recording material P such as a sheet. The intermediate transfer belt 51 is tightly stretched by a drive roller 52, a driven roller 55, and the roller 56. A belt cleaner 60 is disposed on the intermediate transfer belt 51. The belt cleaner 60 removes a residual toner from the intermediate transfer belt 51, the residual toner being not transferred to the recording material P.

A fixing unit 9 includes a heating roller 91 and a pressing roller 92, and fixes a toner image borne on a recording material P with heat and pressure.

In the reader unit 1R, when a user places a document on a document positioning plate and presses a copy button of an operation unit 200, light is emitted from a light source and reflected by the document, and then the reflected light is received by an image sensor 77 via a reflecting mirror. The reflected light from the document received by the image sensor 77 is divided by a color filter into reflection lights of color components of yellow, magenta, cyan, and black, so that the reflection lights are converted into image data to form toner images of the respective color components. The image data of the respective color components is input through a central processing unit (CPU) 120 (see FIG. 3) to exposure devices 3*a*, 3*b*, 3*c*, and 3*d* corresponding to the respective color component of image forming units Pa, Pb, Pc, and Pd.

In the image forming apparatus 100, the CPU 120 executes various image processing on image data upon receipt of the image data transmitted from a personal computer (PC). The image data having undergone the image processing by the CPU 120 is transferred to the exposure devices 3*a*, 3*b*, 3*c*, and 3*d*.

Next, an image forming operation of the image forming apparatus 100 will be described. In the image forming unit Pa, the charging unit 2*a* uniformly charges a surface of the photosensitive drum 1*a*, and the exposure device 3*a* exposes the surface of the photosensitive drum 1*a* to a laser beam modulated according to image data corresponding to yellow, the image data being transferred from a reader unit (not illustrated). Accordingly, an electrostatic latent image corresponding to the yellow component is formed on the surface of the photosensitive drum 1*a*.

Subsequently, the electrostatic latent image on the photosensitive drum 1*a* is visualized with toner of the developing unit 4*a*, and then the visualized image is borne on the photosensitive drum 1*a* as a toner image corresponding to the yellow component. With the rotation of the photosensitive drum 1*a* in a direction indicated by an arrow Ra illustrated in FIG. 1, this toner image is conveyed toward a primary transfer portion Na in which the primary transfer roller 53*a* presses the photosensitive drum 1*a* through the intermediate transfer belt 51. In the primary transfer portion Na, the toner image is transferred to the intermediate transfer belt 51 by transfer voltage applied via the primary transfer roller 53*a*.

As similar to the image forming unit Pa, the image forming units Pb, Pc, and Pd form toner images of respective color components based on color separation of an original image. Each of units disposed in the image forming units Pb, Pc, and Pd is provided with a reference number with a symbol, the reference number corresponding to each of the units of the image forming unit Pa with the symbol being different from that of the image forming unit Pa.

The image forming units Pa, Pb, Pc, and Pd sequentially overlay and transfer toner images of respective color components to the intermediate transfer belt 51, so that a full-color toner image is formed on the intermediate transfer belt 51.

The full-color toner image borne on the intermediate transfer belt 51 is conveyed toward a secondary transfer portion N2 with the rotation of the intermediate transfer belt 51 in a direction indicated by an arrow R2 illustrated in FIG. 1. In the secondary transfer portion N2, the secondary transfer roller 57 presses the roller 56 via the intermediate transfer belt 51. At this time, recording materials P inside a sheet cassette 8 are fed sheet by sheet by a pick-up roller 84, a pair of feeding rollers 85, and a pair of conveyance rollers 86, and each recording material P is conveyed toward the secondary transfer portion N2. A sheet position and feed timing of the recording material P conveyed by the pair of feeding rollers 85 and the pair of conveyance rollers 86 are adjusted by registration rollers 83. The adjusted recording material P is supplied to the secondary transfer portion N2 to come into contact with a toner image on the intermediate transfer belt 51.

The secondary transfer portion N2 corresponds to a position where the secondary transfer roller 57 presses the recording material P against the intermediate transfer belt 51.

When the toner image on the intermediate transfer belt 51 and the recording material P fed from the registration rollers 83 are entered into the secondary transfer portion N2, a transfer voltage is applied to the secondary transfer roller 57, thereby forming a transfer electric field between the roller 56 and the secondary transfer roller 57. Accordingly, the toner image on the intermediate transfer belt 51 is transferred to the recording material P.

After the toner image is transferred to the recording material P in the secondary transfer portion N2, the recording material P is conveyed toward the fixing unit 9. In the fixing unit 9, the recording material P having the transferred toner image is heated by a heater disposed inside the heating roller 91 while being pinched and conveyed by the heating roller 91 and the pressing roller 92, so that the toner image is fixed onto the recording material P. Then, the recording material P having the fixed toner image is discharged from the image forming apparatus 100.

Figure 2:
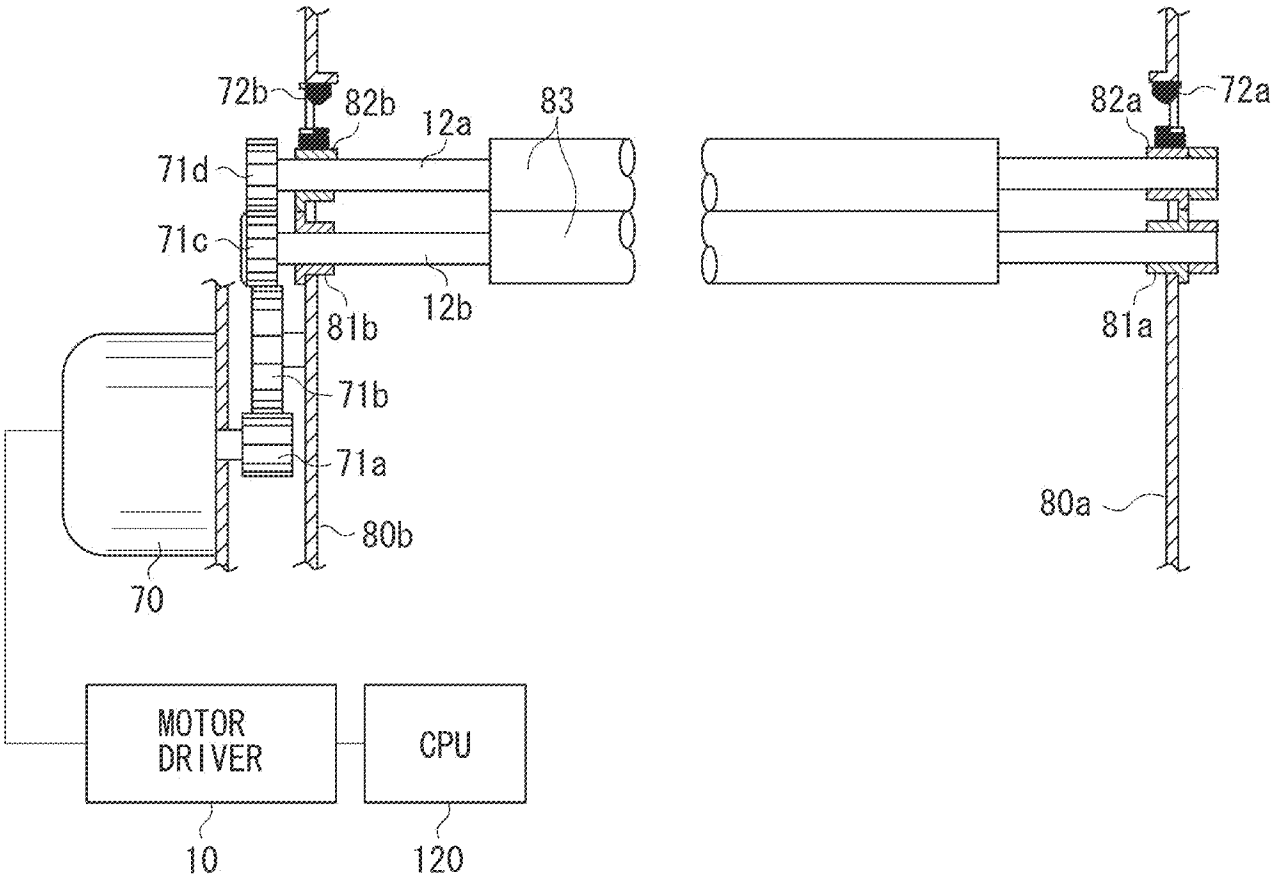
FIG. 2 is a cross-sectional view illustrating a configuration of a registration roller according to the first exemplary embodiment.

A configuration of each unit for driving the registration rollers 83 will be described in detail with reference to FIG. 2. A motor 70 is a stepping motor, and includes a multi-step speed change mechanism. The motor 70 rotates only for a predetermined angle when a motor drive 10 inputs a pulse signal. The motor drive 10 drives the motor 70 at a predetermined rotation speed corresponding to a frequency of the pulse signal controlled according to a signal input from the CPU 120. Assume that the rotation speed of the motor 70 is the number of rotations of a drive shaft of the motor 70 per unit time.

A gear 71*a* is attached to the drive shaft of the motor 70. When the motor 70 is driven, an intermediate gear 71*b* being engaged with the gear 71*a* rotates. This rotation of the intermediate gear 71*b* rotates a gear 71*c* being engaged with the intermediate gear 71*b*, and then a gear 71*d* being engaged with the gear 71*c* rotates. The gear 71*c* is fixed to a drive shaft 12*b* of the registration rollers 83, whereas the gear 71*d* is fixed to a drive shaft 12*a* of the registration rollers 83. Therefore, when the motor 70 is driven by the CPU 120, the registration rollers 83 rotates.

The registration rollers 83 are formed by integrally combining rubber rolls having elasticity with the drive shafts 12*a* and 12*b*. The drive shaft 12*a* is supported by bearings 82*a* and 82*b* disposed on respective side plates 80*a* and 80*b*. As similar to the drive shaft 12*a*, the drive shaft 12*b* is supported by bearings 81*a* and 81*b* disposed on the respective side plates 80*a* and 80*b*. The bearings 82*a* and 82*b* are fit into long thin holes provided in the respective side plates 80*a* and 80*b*. The bearings 82*a* and 82*b* are pressed by springs 72*a* and 72*b* in a direction of the bearings 81*a* and 81*b*, respectively. Therefore, if the registration rollers 83 are not rotationally driven, the recording material P abuts on the registration rollers 83 and stops. When the registration rollers 83 are rotationally driven, the recording material P is pinched and conveyed by the registration rollers 83.

Figure 3:
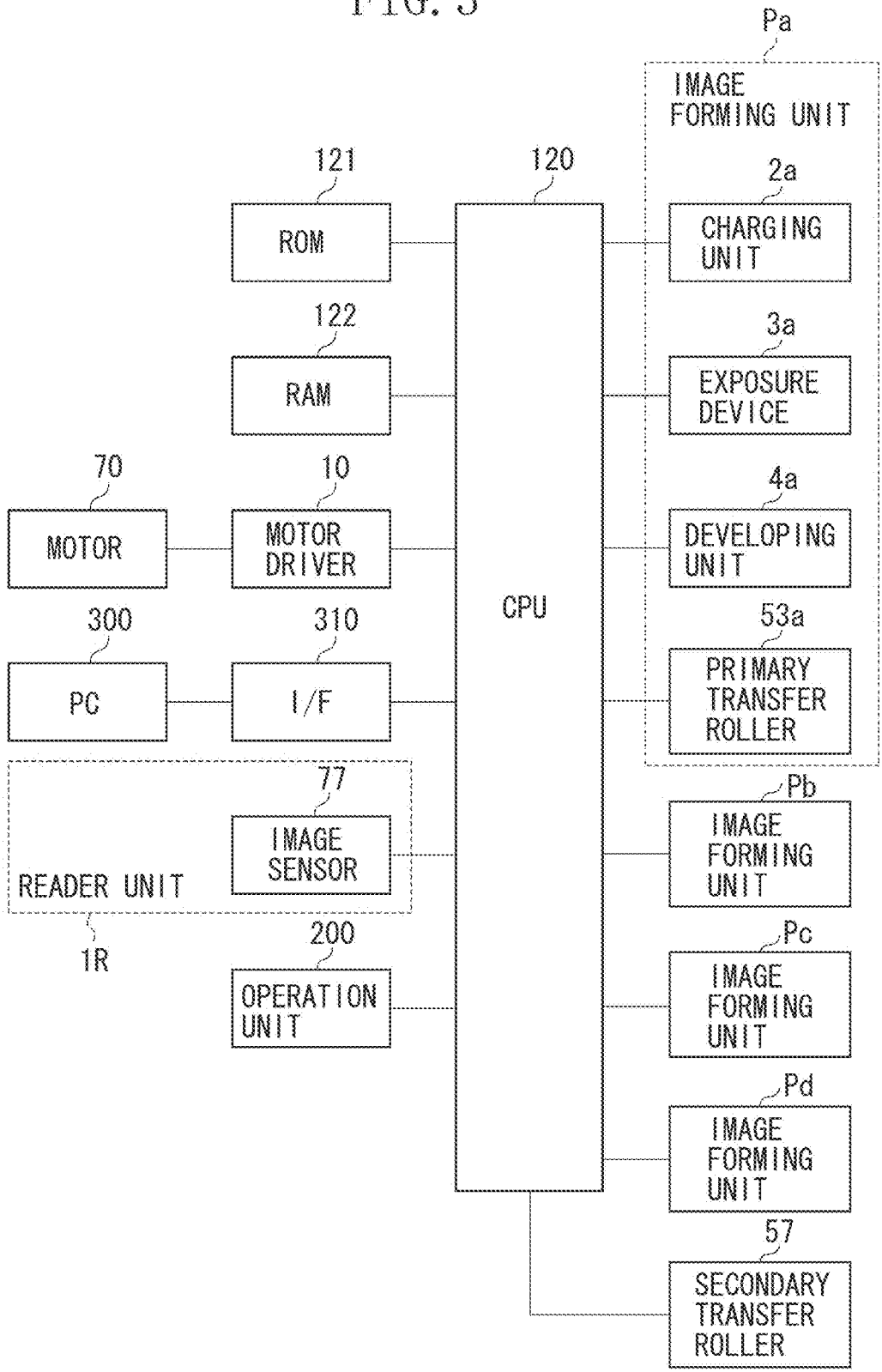
FIG. 3 is a block diagram illustrating a configuration of the image forming apparatus according to the first exemplary embodiment.

FIG. 3 is a control block diagram illustrating the image forming apparatus 100 of the present exemplary embodiment. The CPU 120 is a control circuit for controlling the entire image forming apparatus. A read only memory (ROM) 121 stores a control program for controlling various processing to be executed in the image forming apparatus 100. A random access memory (RAM) 122 is a system work memory for the CPU 120 to operate.

To rotate the motor 70 at a rotation speed according to a signal output from the CPU 120, the motor drive 10 outputs a pulse signal having a frequency corresponding to the rotation speed to the motor 70. The motor 70 rotates at the speed corresponding to the frequency of the pulse signal output from the motor drive 10, thereby rotationally driving the registration rollers 83. In the present exemplary embodiment, the CPU 120 outputs signals, stored in the ROM 121 beforehand, corresponding to a plurality of rotation speeds to the motor drive 10.

An interface (I/F) 310 outputs to the CPU 120 image data input from a personal computer (PC) 300 serving as an external device.

The operation unit 200 includes a numeric keypad for inputting, for example, the number of copies to make, a copy button for starting image formation, a button for selecting the number of copies and a sheet type of a recording material P or setting a print mode such as one-sided printing and two-sided printing, and a liquid crystal screen for displaying a guidance for assisting various operations of the image forming apparatus 100. When a user operates any of these buttons, for example, information of a sheet type of the recording material P, the number of copies, one-sided printing, or two-sided printing selected by the user is input to the CPU 120. In the present exemplary embodiment, the liquid crystal screen has a touch panel.

Moreover, when the user performs a predetermined input from the operation unit 200, a signal for executing control to adjust a speed at which the registration rollers 83 convey the recording material P is output to the CPU 120. The operation unit 200 may be a keyboard of the PC 300 connected to the image forming apparatus 100 via a network. The operation unit 200 may have any configuration as long as a signal for executing control to adjust a speed (hereinafter referred to as a conveyance speed) at which the recording material P is conveyed by the registration rollers 83 can be output from the operation unit 200 to the CPU 120 when a user performs the predetermined input.

Since the image forming units Pa, Pb, Pc, and Pd and the image sensor 77 are described above with reference to FIG. 1, detailed descriptions thereof are omitted.

Next, a description is given of a reason for setting a conveyance speed of the recording material P by the registration rollers 83 to be higher than a conveyance speed of a toner image conveyed by the intermediate transfer belt 51.

Figure 4A:
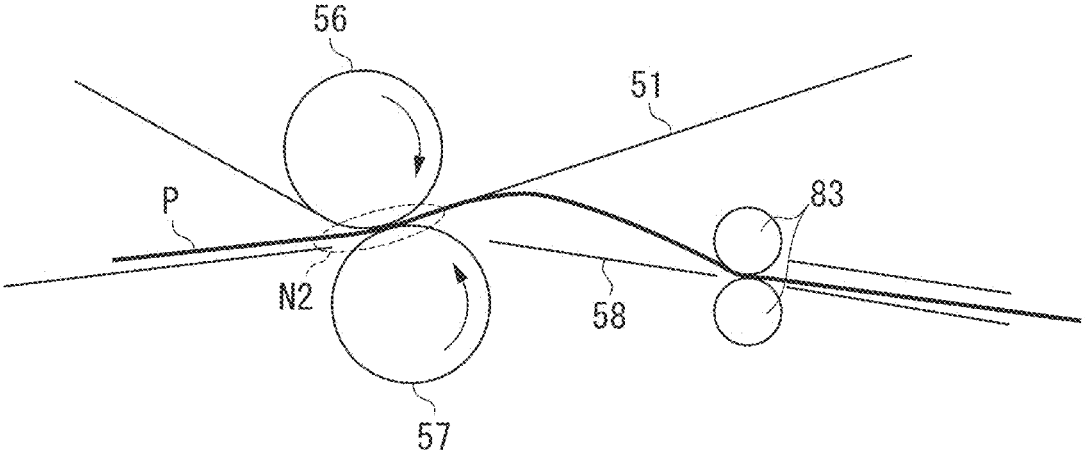
FIGS. 4A and 4B are schematic diagrams each illustrating a main part of the registration roller and a secondary transfer unit according to the first exemplary embodiment.
Figure 4B:
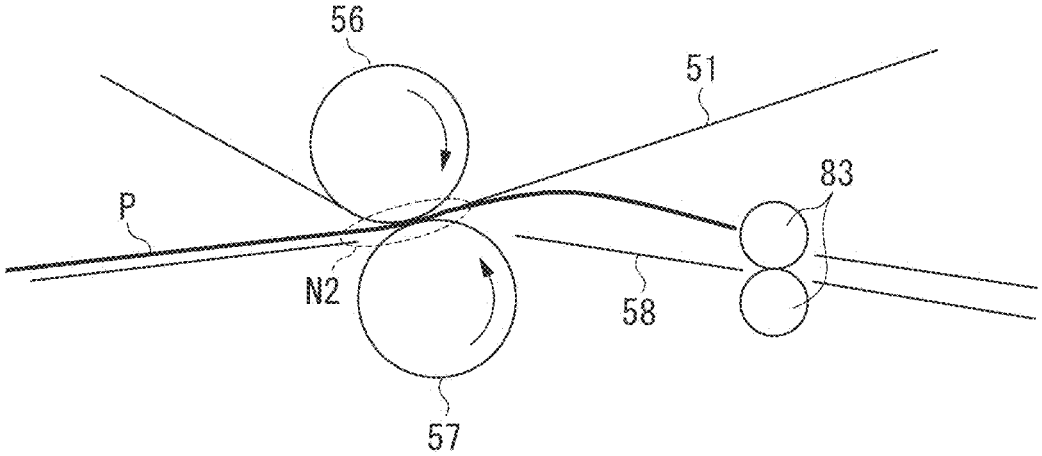

FIG. 4A is a schematic diagram illustrating a state in which a recording material P passes the secondary transfer portion N2 while being pinched by the registration rollers 83. FIG. 4B is a schematic diagram illustrating a state in which the recording material P passes through the secondary transfer portion N2 while being pinched by the intermediate transfer belt 51 and the secondary transfer roller 57 after a tailing edge of the recording material P passes through the registration rollers 83. Herein, the recording material P passes the secondary transfer portion N2 at the same speed as a speed at which a toner image is conveyed by the intermediate transfer belt 51 regardless of whether the recording material P is pinched by the registration rollers 83. Such a situation is provided since the force for pinching the recording material P by the intermediate transfer belt 51 and the secondary transfer roller 57 is greater than that by the registration rollers 83.

As illustrated in FIG. 4A, when the recording material P is conveyed while being pinched by the registration rollers 83, the recording material P is distorted to approach the intermediate transfer belt 51 on an upstream side relative to the secondary transfer portion N2 in a direction in which the toner image is conveyed by the intermediate transfer belt 51. This distortion is generated since a speed at which the recording material P passes the secondary transfer portion N2 is lower than that at which the recording material P is fed to the secondary transfer portion N2 by the registration rollers 83, and a guide 58 regulates a distortion of the recording material P toward the opposite side of the intermediate transfer belt 51. Therefore, the recording material P is conveyed while narrowing a gap between the recording material P and the intermediate transfer belt 51 on the upstream side relative to the secondary transfer portion N2 in the conveyance direction of the recording material P. Accordingly, the image forming apparatus 100 causes application of a transfer voltage to the secondary transfer roller 57 and execution of a transfer operation in a state that the gap between the recording material P and the intermediate transfer belt 51 is narrow. Consequently, the image forming apparatus 100 can suppress the transfer of the toner to an area on the intermediate transfer belt 51, the area being to which toner should not adhere.

As illustrated in FIG. 4B, after the tailing edge of the recording material P in a conveyance direction of the recording material P passes through the registration rollers 83, the recording material P is released from the force pressing the recording material P against the intermediate transfer belt 51 by the registration rollers 83. Herein, if the recording material P being conveyed is pressed against the intermediate transfer belt 51 with a strong force by the registration rollers 83, the recording material P damages a toner image on the intermediate transfer belt 51. A cause of the damage is described with reference to FIGS. 5A, 5B, and 6 below. After the tailing edge of the recording material P passes through the registration rollers 83, the recording material P is pinched and conveyed by the intermediate transfer belt 51 and the secondary roller transfer 57.

In the present exemplary embodiment, the CPU 120 controls the rotation speed of the motor 70, thereby controlling the speed at which the recording material P is conveyed toward the secondary transfer portion N2 by the registration rollers 83. For example, assume that a conveyance speed of the recording material P in the secondary transfer portion N2 is 100, and a conveyance speed of the recording material P by the registration rollers 83 is 101 (target speed). A change in an outer diameter of the registration rollers 83 causes a change in speed of conveying the recording material P by the registration rollers 83 although the rotation speed of the motor 70 remains unchanged.

When the conveyance speed by the registration rollers 83 becomes higher than the target speed, the force to press the recording material P against the intermediate transfer belt 51 increases on an upstream side of the secondary transfer portion N2 in a direction in which the intermediate transfer belt 51 conveys a toner image. Consequently, a force is generated on the recording material P such that the recording material P rubs the toner image on the intermediate transfer belt 51 toward a direction opposite to that in which the intermediate transfer belt 51 conveys the toner image, causing damaging the toner image on the intermediate transfer belt 51.

Figure 5A:
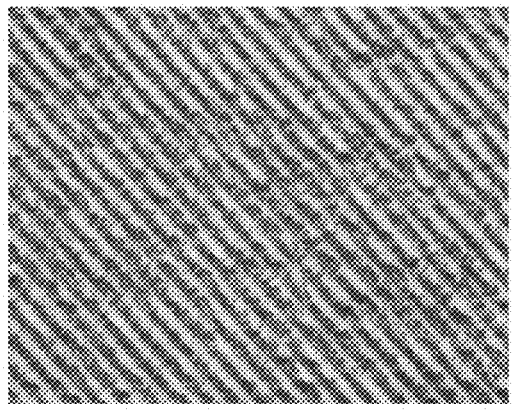
FIGS. 5A and 5B are diagrams each illustrating an image output from the image forming apparatus according to the first exemplary embodiment.
Figure 5B:
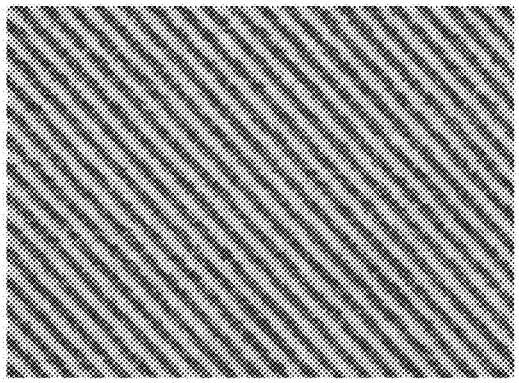

FIG. 5A is an enlarged view illustrating a halftone image formed on a recording material P when the conveyance speed of the recording material P by the registration rollers 83 is higher than the target speed. FIG. 5B is an enlarged view illustrating a halftone image formed on a recording material P when the conveyance speed of the recording material P by the registration rollers 83 becomes the target speed.

Figure 6:
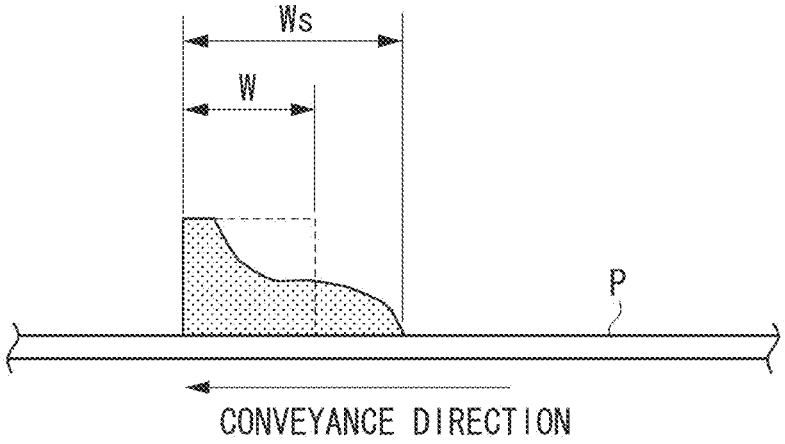
FIG. 6 is a cross-sectional view illustrating an image output from the image forming apparatus according to the first exemplary embodiment.

Each halftone image of FIGS. 5A and 5B is formed such that a line toner image has a width W of 42.3 μm and adjacent line toner images have a distance of 42.3 μm therebetween. FIG. 6 is a diagram schematically illustrating a cross section of one line toner image illustrated in FIG. 5A, the cross section being taken along a direction perpendicular to a line direction of this line toner image.

If the force pressing the recording material P against the intermediate transfer belt 51 becomes excessive on an upstream side relative to the secondary transfer portion N2 in a direction in which the intermediate transfer belt 51 conveys a toner image, a line toner image formed on the recording material P is damaged as illustrated in FIG. 5A. Such damage is caused by rubbing the toner image on the intermediate transfer belt 51 with the recording material P.

When the recording material P rubs the toner image on the intermediate transfer belt 51, a toner image transferred to the recording material P in the secondary transfer portion N2 has a width Ws covered with toner as illustrated in FIG. 6, the width Ws being wider than a target width W. Herein, if a density of the toner image is changed by adjusting a distance between a plurality of line toner images, a density of an area having the plurality of line toner images increases as a distance between the adjacent line toner images is narrowed. Thus, in an area having a plurality of line toner images each having the width Ws wider than the target width W due to the toner image damaged by the recording material P, a density thereof is higher than that of an area having a plurality of line toner images each having the target width W.

In FIG. 5A, moreover, the halftone image has an area having a damaged toner image and an area having a non-damaged toner image. Since a surface of the recording material P has a little unevenness, these two areas are generated. The damaged area is caused by rubbing the toner image on the intermediate transfer belt 51 with the recording material P, whereas the non-damaged area is not rubbed with the recording material P. For example, even when line images are formed to have a uniform density, a toner image can be partially damaged by being rubbed with the recording material P. In such a case, the line images do not have a uniform density as illustrated in FIG. 5A. Moreover, for example, even if a solid image in which toner is uniformly provided across a predetermined area is formed instead of line images, a toner image is partially damaged by a convex portion of a recording material P, causing an image having low smoothness to be formed on the recording material P.

On the other hand, when line toner images are formed on a recording material P in a state that a tailing edge of the recording material P passes through the registration rollers 83 in the conveyance direction of the recording material P, the line image has a target width W as illustrated in FIG. 5B. When the tailing edge of the recording material P passes through the registration rollers 83, the force pressing the recording material P is decreased on an upstream side relative to the secondary transfer portion N2 in the conveyance direction of the toner image by the intermediate transfer belt 51, thereby forming the toner image as illustrated in FIG. 5B.

In other words, images having different density are formed on one recording material P. On the recording material P, there is an image transferred to the recording material P before a tailing edge of the recording material P passes through the registration rollers 83 in a conveyance direction of the recording material P, and an image transferred to the recording material P after the tailing edge of the recording material P passes through the registration rollers 83 in a conveyance direction of the recording material P.

Figure 7:
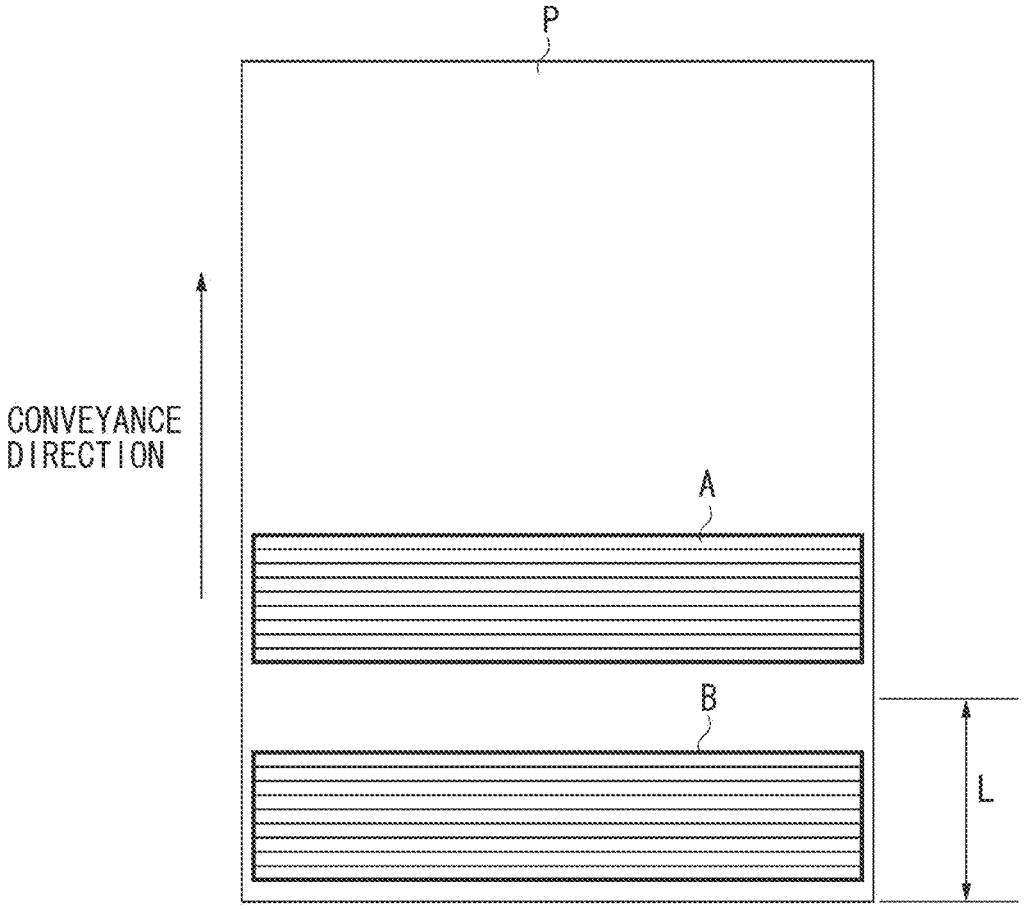
FIG. 7 is a schematic diagram illustrating a test sheet formed by the image forming apparatus according to the first exemplary embodiment.

Accordingly, in the present exemplary embodiment, the CPU 120 (FIG. 3) causes a plurality of test sheets T to be formed by changing a conveyance speed of the recording material P by the registration rollers 83, and determines a conveyance speed at which an image can be formed without a density difference across one page. Herein, FIG. 7 is a test sheet T output from the image forming apparatus 100 of the present exemplary embodiment. This test sheet T has an image A and an image B each having 2000 lines of toner images. Each line toner image in the images A and B has a width of 42.3 μm in a direction perpendicular to a line direction thereof, and adjacent line toner images have a distance of 42.3 μm therebetween. The width of the line toner image and the distance between the adjacent line toner images are not limited thereto, and may be determined in consideration of a spot diameter of the laser beam of each of the exposure devices 3*a*, 3*b*, 3*c*, and 3*d*, or a toner particle size. Moreover, the number of line toner images to be formed in an area of the image A, and the number of line toner images to be formed in an area of the image B are not limited to that of the present exemplary embodiment. Any number of line toner images may be formed.

Each of the images A and B can be formed such that a longitudinal direction of a line toner image is inclined with respect to a conveyance direction of the recording material P. For example, a longitudinal direction of a line toner image can be arranged perpendicular to a conveyance direction of the recording material P. This can facilitate recognition of changes in density of line toner images formed on the test sheet T.

A recording material P rubs a toner image on the intermediate transfer belt 51 in a direction in which the intermediate transfer belt 51 conveys the toner image. Consequently, a longitudinal direction of the line toner image is arranged perpendicular to a direction in which the toner image is conveyed by the intermediate transfer belt 51, so that a density of the toner image formed on the recording material P can be changed significantly when the recording material P damages the toner image on the intermediate transfer belt 51. The test sheet T having the image A and the image B on the recording material P functions as a test sheet, and each of the images A and B corresponds to a test image formed on the test sheet.

The image A is formed in a first region located a length L or more away from a tailing edge toward a leading edge side of the test sheet T in a conveyance direction of the recording material P. In the present exemplary embodiment, the first region has a length of 50 mm in the conveyance direction of the recording material P. The first region is an area from a position 80 mm away from the tailing edge of the recording material P in the conveyance direction of the recording material P to a position 130 mm away from the tailing edge of this recording material P. The image B is formed in a second region located toward a tailing edge side relative to a position of a length L from the tailing edge of the test sheet T in a conveyance direction of the recording material P. In the present exemplary embodiment, the second region has a length of 50 mm in the conveyance direction of the recording material P. The second region is an area from a position 10 mm away from the tailing edge of the recording material P in the conveyance direction of the recording material P to a position 60 mm away from the tailing edge of this recording material P. Herein, the length L is 80 mm in the present exemplary embodiment. However, the length L may be determined according to a distance between the secondary transfer portion N2 and the registration rollers 83, and a length from a leading edge to a tailing edge of the test sheet T in the conveyance direction of the recording material P.

This is because an image formed on the tailing edge side relative to a position of the length L from the tailing edge of the test sheet T in the conveyance direction of the recording material P becomes an image formed on the recording material P after the tailing edge of the recording material P passes through the registration rollers 83. Therefore, if a recording material P damages a toner image on the intermediate transfer belt 51, a damaged toner image is transferred to the image A and a non-damaged toner image is transferred to the image B since the conveyance speed of the recording material P by the registration rollers 83 is higher than the target speed. Consequently, the length L becomes shorter as a distance between the secondary transfer portion N2 and the registration rollers 83 becomes longer. The length L becomes longer as a length from a leading edge to a tailing edge of the test sheet T becomes longer.

Next, a method for specifying a conveyance speed allowing formation of an image without density unevenness according to the present exemplary embodiment will be described, the conveyance speed being specified by outputting test sheets T by changing a conveyance speed at which the registration rollers 83 convey a recording material in a multi-step manner. In the present exemplary embodiment, the CPU 120 changes a rotation speed of the motor 70 for driving the registration rollers 83 in five steps to change the conveyance speed at which the registration rollers 83 conveys the recording material P. Specifically, a rotation speed of the motor 70 may be changed such that a speed Vb at which the intermediate transfer belt 51 conveys a toner image and a conveyance speed Vn at which the registration rollers 83 convey a recording material have the following relationship.

$$Vb:Vn=100:100.4 \quad 1)$$

$$Vb:Vn=100:100.7 \quad 2)$$

$$Vb:Vn=100:101.3 \quad 3)$$

$$Vb:Vn=100:101.0 \quad 4)$$

$$Vb:Vn=100:101.7 \quad 5)$$

The rotation speed of the motor 70 is not limited to the five steps. The rotation speed of the motor 70 may be less than five steps or six steps or more.

Figure 8:
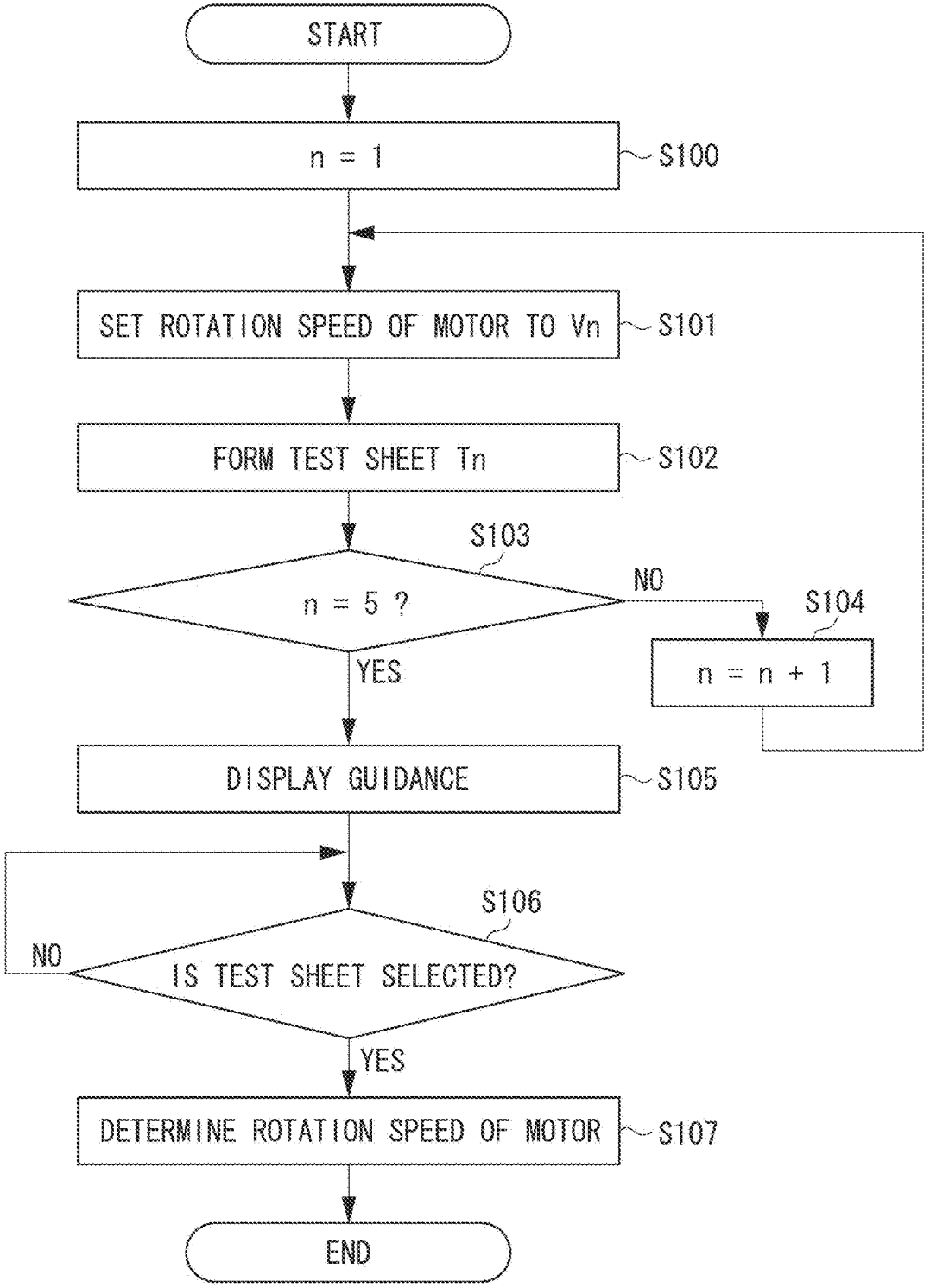
FIG. 8 is a flowchart illustrating speed control processing on the registration roller according to the first exemplary embodiment.

FIG. 8 is a flowchart illustrating conveyance speed adjustment processing executed by the CPU 120 to adjust a conveyance speed at which the registration rollers 83 convey a recording material P according to the present exemplary embodiment. In the present exemplary embodiment, when a user changes a type of a recording material P on which an image is to be formed, when the predetermined number of sheets having images thereon is output, or when temperature or humidity near the image forming apparatus 100 changes, the operation unit 200 displays a message prompting a user to allow execution of the conveyance speed adjustment processing. If the system has a possibility that an image having a uniform density cannot be formed due to any other reasons, the operation unit 200 may display a message according to the other reasons.

In the present exemplary embodiment, when the user inputs a signal for executing the conveyance speed adjustment processing via the operation unit 200, the CPU 120 executes the processing in the flowchart illustrated in FIG. 8. The processing in the flowchart illustrated in FIG. 8 is executed by reading a program stored in the ROM 121 by the CPU 120.

In step S100, the CPU 120 sets 1 to a value of a conveyance speed counter n. In step S101, the CPU 120 sets a rotation speed of the motor 70 according to the value of the conveyance speed counter n. In step S101, the CPU 120 selects a pulse signal among pulse signals having different waveforms stored beforehand in the ROM 121 according to the value of the conveyance speed counter n, and inputs the selected pulse signal to the motor drive 10, thereby rotating the motor 70 at the rotation speed corresponding to the frequency of the pulse signal.

Herein, when a value of the conveyance speed counter n is 1, the CPU 120 drives the motor 70 at a rotation speed at which the ratio between the speed Vb of a toner image conveyance by the intermediate transfer belt 51 and the conveyance speed Vn at which the registration rollers 83 convey a recording material P becomes 100:100.4. Similarly, when a value of the conveyance speed counter n is 2, the CPU 120 drives the motor 70 at a rotation speed at which the ratio between the speed Vb of a toner image conveyance by the intermediate transfer belt 51 and the conveyance speed Vn at which the registration rollers 83 convey a recording material P becomes 100:100.7. When a value of the conveyance speed counter n is 3, the CPU 120 drives the motor 70 at a rotation speed at which the ratio between the speed Vb of a toner image conveyance by the intermediate transfer belt 51 and the conveyance speed Vn at which the registration rollers 83 convey a recording material P becomes is 100:101.3. When a value of the conveyance speed counter n is 4, the CPU 120 drives the motor 70 at a rotation speed at which the ratio between the speed Vb of a toner image conveyance by the intermediate transfer belt 51 and the conveyance speed Vn at which the registration rollers 83 convey a recording material P becomes 100:101.0. When a value of the conveyance speed counter n is 5, the CPU 120 drives the motor 70 at a rotation speed at which the ratio between the speed Vb of a toner image conveyance by the intermediate transfer belt 51 and the conveyance speed Vn at which the registration rollers 83 convey a recording material P becomes 100:101.7.

Subsequently, in step S102, the CPU 120 forms a test sheet Tn by transferring images A and B illustrated in FIG. 7 formed by any one of the image forming units Pa, Pb, Pc, and Pd to a recording material P. In step S102, the CPU 120 causes the motor 70 to rotationally drive by the pulse signal selected in step S101, and causes the registration rollers 83 to convey the recording material P to form the images A and B on the recording material P. In step S102, the CPU 120 forms the test sheet Tn using any one of the image forming units Pa, Pb, Pc, and Pd according to predetermined image data stored in the ROM 121.

In step S103, the CPU 120 identifies whether a value of the conveyance speed counter n is 5. If the value of the conveyance speed counter n is smaller than 5 (No in step S103), the CPU 120 determines that all the test sheets T are not formed, and the operation proceeds to step S104. In step S104, the CPU 120 increases the value of the conveyance speed counter n by 1, and then the operation returns to step S101. The CPU 120 can form the five test sheets T while changing the rotation speed of the motor 70 by repeating step S101 through step S104.

On the other hand, if the value of the conveyance speed counter n is 5 (YES in step S103), then in step S105, the CPU 120 causes a liquid crystal screen of the operation unit 200 to display a guidance to allow a user to select what number-th output sheet is the test sheet T having the smallest density difference between the image A and the image B. Subsequently, in step S106, the CPU 120 waits until information about what number-th output sheet is the test sheet T having the smallest density difference is input from the operation unit 200. In step S106, the CPU 120 continues to wait until the user inputs any one of the numeric numbers from 1 through 5 using a numeric keypad of the operation unit 200 and presses a determination button.

If the information is input from the operation unit 200 (YES in step S106), then in step S107, the CPU 120 determines the rotation speed of the motor 70 during the formation of the test sheet T indicated by the information as a rotation speed to be used when a toner image corresponding to image data is formed. Herein, the operation unit 200 functions as a selection unit for allowing a user to select the test sheet T having the smallest density difference between the image A and the image B. In step S107, the CPU 120 specifies the pulse signal used to drive the motor 70 during the formation of the selected test sheet T, and stores the specified pulse signal in the RAM 122 as a pulse signal to be used when a toner image corresponding to image data input by reading a document or by an external PC is formed.

The CPU 120 can drive the motor 70 at the rotation speed determined by step S107, thereby conveying the recording material P at a conveyance speed which can suppress occurrence of a density difference in an image to be formed on the recording material P.

According to the present exemplary embodiment, therefore, occurrence of a density difference in an image to be formed on a recording material P can be suppressed before and after a tailing edge of the recording material P passes through the registration rollers 83.

A second exemplary embodiment of the present invention will be described with reference to FIGS. 1, 3, 7, 9, and 10. The present exemplary embodiment differs from the first exemplary embodiment in the following points. Since components of the present exemplary embodiment are substantially the same as those of the first exemplary embodiment, descriptions thereof are omitted.

In the first exemplary embodiment, a user is caused to select a test sheet having the smallest density difference between an image A and an image B among a plurality of test sheets T, thereby determining a conveyance speed which can suppress a density difference in an image output from the image forming apparatus 100. In the present exemplary embodiment, a reader unit 1R is caused to read a plurality of test sheets T output from an image forming apparatus 100, thereby determining a conveyance speed which can suppress a density difference in an image output from the image forming apparatus 100. The reader unit 1R functions as a density detection unit for detecting a density difference between the image A and the image B on a test sheet T.

Figure 9:
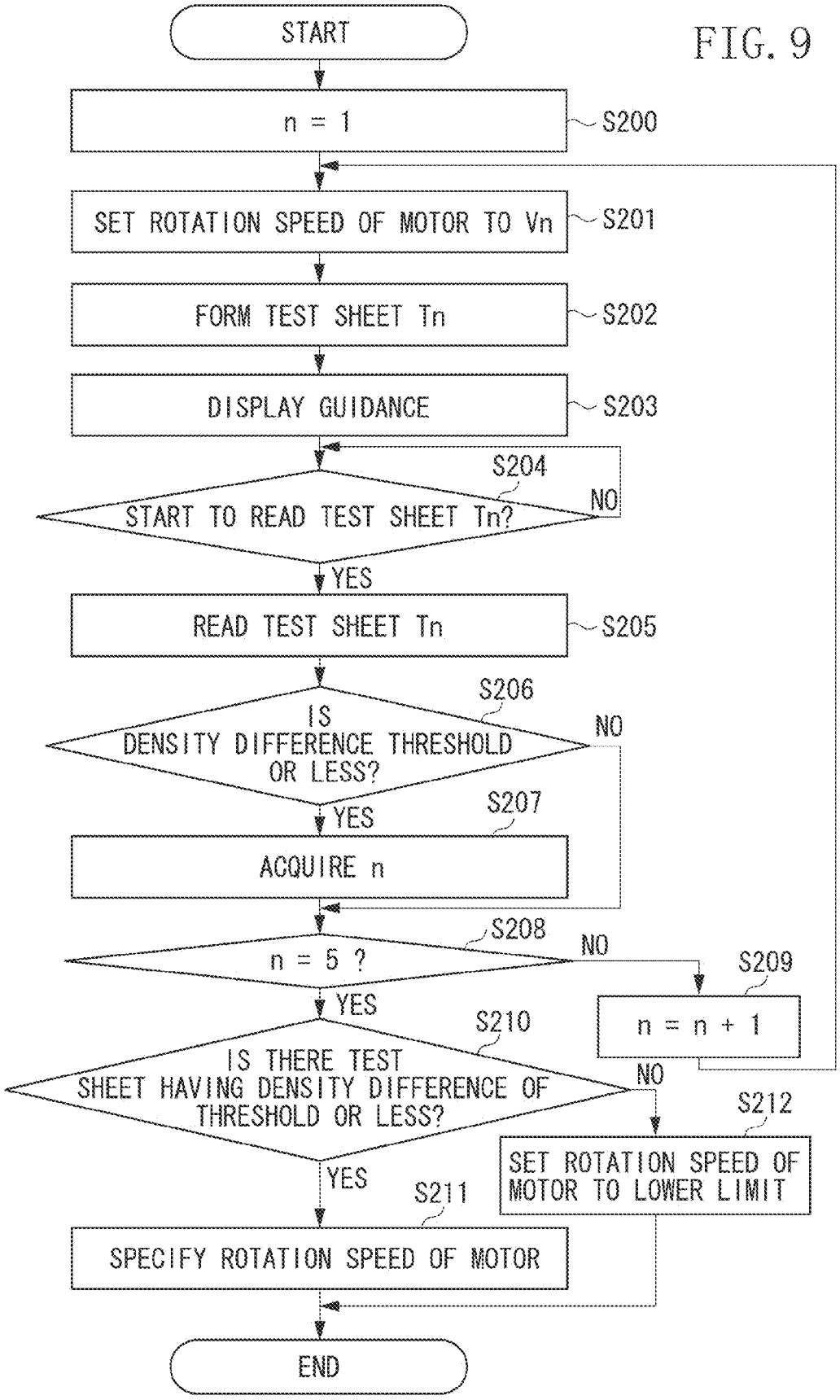
FIG. 9 is a flowchart illustrating speed control processing on a registration roller according to a second exemplary embodiment.

FIG. 9 is a flowchart illustrating conveyance speed adjustment processing executed by a CPU 120 to adjust a conveyance speed. In the present exemplary embodiment, when a user inputs a signal for executing the conveyance speed adjustment processing to the CPU 120 via an operation unit 200, the CPU 120 executes the processing of the flowchart illustrated in FIG. 9. The CPU 120 reads a program stored in a ROM 121 to execute the processing of the flowchart illustrated in FIG. 9.

In step S200, the CPU 120 sets 1 to a value of a conveyance speed counter n. In step S201, the CPU 120 sets a rotation speed of a motor 70 according to the value of the conveyance speed counter n. In step S201, the CPU 120 selects a pulse signal stored beforehand in the ROM 121 according to the value of the conveyance speed counter n, and inputs the selected pulse signal to a motor drive 10, thereby rotating the motor 70 at a rotation speed corresponding to the frequency of the pulse signal.

Subsequently, in step S202, the CPU 120 forms a test sheet Tn by transferring images A and B illustrated in FIG. 7 formed by any one of the image forming units Pa, Pb, Pc, and Pd to a recording material P. In step S202, the CPU 120 causes the motor 70 to rotationally drive by using the pulse signal selected in step S201, and causes the registration rollers 83 to convey the recording material P to form the images A and B on the recording material P.

In step S203, the CPU 120 causes a liquid crystal display of the operation unit 200 to display a guidance to allow the user to cause the reader unit 1R to execute reading of the test sheet Tn. Herein, the liquid crystal display of the operation unit 200 displays the guidance to the user to place the test sheet Tn on the reader unit 1R and then press a copy button of the operation unit 200. In step S204, the CPU 120 waits until the copy button of the operation unit 200 is pressed.

If the copy button of the operation unit 200 is pressed (YES in step S204), then in step S205, the CPU 120 reads the images A and B on the test sheet Tn by the above method using an image sensor 77.

Subsequently, in step S206, the CPU 120 determines whether a difference between a density of the image A and a density of the image B read in step S205 is a threshold value or less. Herein, the density difference of the threshold value or less indicates that, for example, a density difference between the images A and B measured by a spectral densitometer 530 manufactured by X-Rite, Inc. may be 0.05 or less. In step S206, if the density difference between the images A and B read by using the image sensor 77 is the threshold value corresponding to the density difference of 0.05 measured by the spectral densitometer 530 or less, the CPU 120 determines that the density difference between the images A and B is the threshold value or less. The threshold value can be a value smaller than a value corresponding to a density difference clearly identifiable by human eyes. In step S206, the CPU 120 may determine whether a difference between an average value Da of density values in a predetermined area within the image A and an average value Db of density values in a predetermined area within the image B is the threshold value or less.

If the density difference between the average value Da of density values of respective pixels in the predetermined area within the image A and the average value Db of density values of respective pixels in the predetermined area within the image B is the threshold value or less (YES in step S206), the operation proceeds to step S207. In step S207, the CPU 120 acquires a value of the conveyance speed counter n and stores the acquired value in the RAM 122. When the acquired value is stored, the operation proceeds to step S208.

On the other hand, if the density difference between the average value Da of density values of respective pixels in the predetermined area within the image A and the average value Db of density values of respective pixels in the predetermined area within the image B is greater than the threshold value (NO in step S206), then in step S208, the CPU 120 identifies whether a value of the conveyance speed counter n is 5. If the value of the conveyance speed counter n is smaller than 5 (NO in step S208), the CPU 120 determines that all five test sheets T1, T2, T3, T4, and T5 are not formed. Subsequently, in step S209, the CPU 120 increases the value of the conveyance speed counter n by 1, and then the operation returns to step S201. The CPU 120 can form all the five test sheets T1, T2, T3, T4, and T5 while changing the rotation speed of the motor 70 by repeating step S201 through step S209.

On the other hand, if the value of the conveyance speed counter n is 5 (YES in step S208), then in step S210, the CPU 120 determines whether there is a test sheet T having a density difference between the images A and B of the threshold value or less. If there is a test sheet having the density difference between the images A and B of the threshold or less (YES in step S210), then in step S211, the CPU 120 specifies a rotation speed of the motor 70 set according to the value of the conveyance speed counter n at the time of formation of this test sheet T.

In step S211, when there is a plurality of test sheets T each having a density difference between the images A and B of the threshold value or less, the CPU 120 sets the rotation speed of the highest motor 70 as a rotation speed to be used at the time of formation of a toner image according to image data input by reading a document or by an external PC. This setting is made since image quality can be deteriorated due to scattering of toner if an actual speed at which the registration rollers 83 convey the recording material P and a speed at which the intermediate transfer belt 51 conveys a toner image differ little from each other.

When there is a plurality of test sheets T each having a density difference between the images A and B of the threshold value or less, the CPU 120 may set the conveyance speed used when the test sheet T having the smallest density difference between the images A and B is formed to a conveyance speed to be used when a toner image is transferred to the recording material P. In other words, the rotation speed of the motor 70 during the formation of the test sheet T having the smallest density difference between the images A and B among the plurality of test sheets T is set as a rotation speed to be used when a toner image is formed according to image data input by reading a document or by an external PC.

The CPU 120 drives the motor 70 at the rotation speed determined in step S211, so that a recording material P can be conveyed at a conveyance speed which can suppress occurrence of a density difference in an image to be formed on the recording material P.

On the other hand, if there is no test sheet having the density difference between the images A and B of the threshold value or less (NO in step S210), then in step S212, the CPU 120 sets the rotation speed of the motor 70 to a predetermined lower limit rotation speed. This setting is made since a recording material P conveyed toward a secondary transfer portion N2 by the registration rollers 83 tends to be jammed as a rotation speed of the motor 70 becomes higher. Herein, assume that the predetermined lower limit rotation speed is a rotation speed of the motor 70 such that a ratio between a speed Vb at which the intermediate transfer belt 51 conveys a toner image and a conveyance speed Vn at which the registration rollers 83 convey the recording material P becomes Vb:Vn=100:100.4. In other words, the CPU 120 sets the conveyance speed Vn of the recording material P conveyed by the registration rollers 83 to a lowest conveyance speed among predetermined conveyance speeds.

Figure 10:
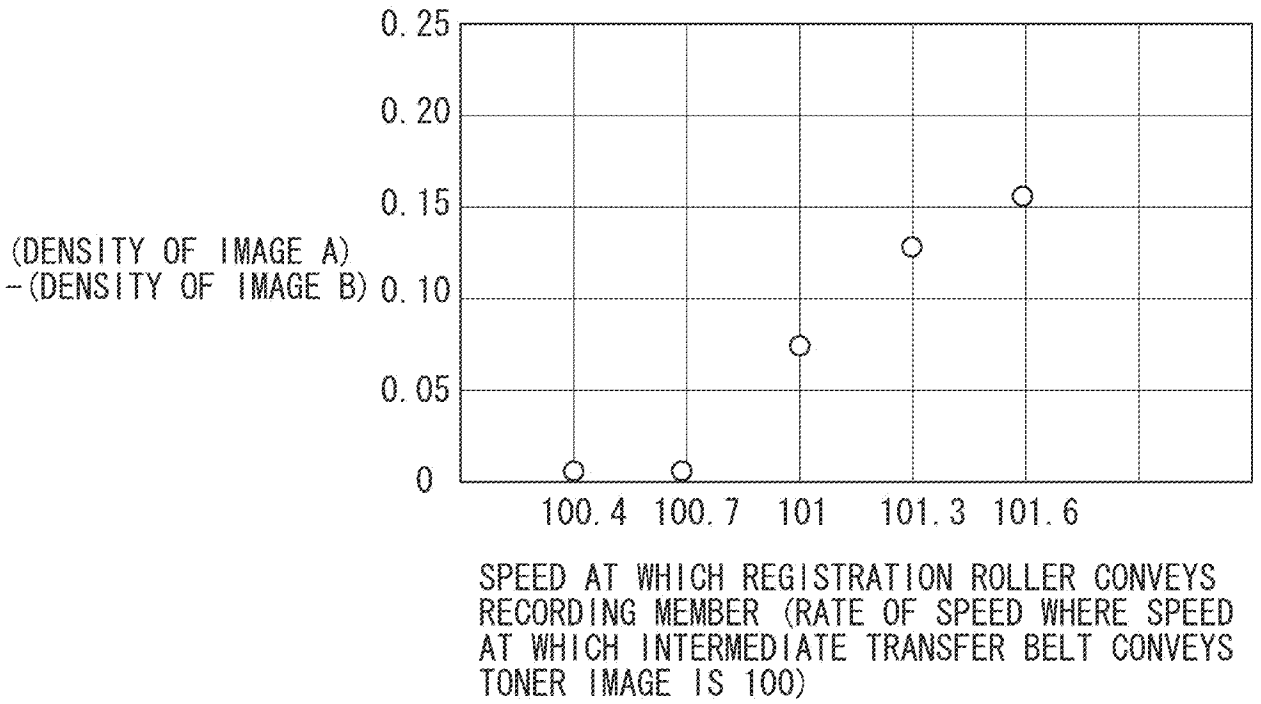
FIG. 10 is a diagram illustrating a relationship between a density difference of images output according to the second exemplary embodiment and a speed of conveying recording material by the registration roller.

FIG. 10 is a diagram illustrating a correlation between the conveyance speed Vn in conveyance of the recording material P by the registration rollers 83 and a density difference between the image A and the image B on each test sheet T, the correlation being measured by forming the test sheets T by changing the rotation speed of the motor 70. In FIG. 10, a horizontal axis represents a rate of the conveyance speed Vn of the recording material P conveyed by the registration rollers 83 to the speed Vb of the toner image conveyance by the intermediate transfer belt 51, the rate being expressed in percentage value.

In FIG. 10, when the conveyance speed Vn of the recording material P conveyed by the registration rollers 83 is higher than the speed Vb of the toner image conveyance by the intermediate transfer belt 51 by 1.0% or more, a density difference between the images A and B to be formed on the test sheet T becomes more than 0.05. In such a case, the CPU 120 sets a rotation speed at which a ratio of Vb:Vn=100:100.7 can be expected to a rotation speed of the motor 70 for formation of an image corresponding to image data. Although the rotation of the motor 70 is set to the speed at which the ratio of Vb:Vn=100:100.7 is expected, the conveyance speed Vn of the recording material P by the registration rollers 83 is not always higher than the speed Vb of the toner image conveyance by the intermediate transfer belt 51 by 0.7% since the conveyance speed Vn of the recording material P by the registration rollers 83 is determined by an outer diameter of the registration rollers 83 at that point in time and the rotation speed of the motor 70.

According to the present exemplary embodiment, occurrence of density difference in an image to be formed on a recording material P can be suppressed before and after a tailing edge of this recording material P passes through the registration rollers 83.

In the second exemplary embodiment, the user causes the test sheet T to be read by the reader unit 1R. However, densities of the image A and the image B on a test sheet T may be automatically read using an image sensor such as a charge coupled device (CCD) on a downstream side relative to a fixing unit 9 in a conveyance direction of the recording material P.

Figure 11:
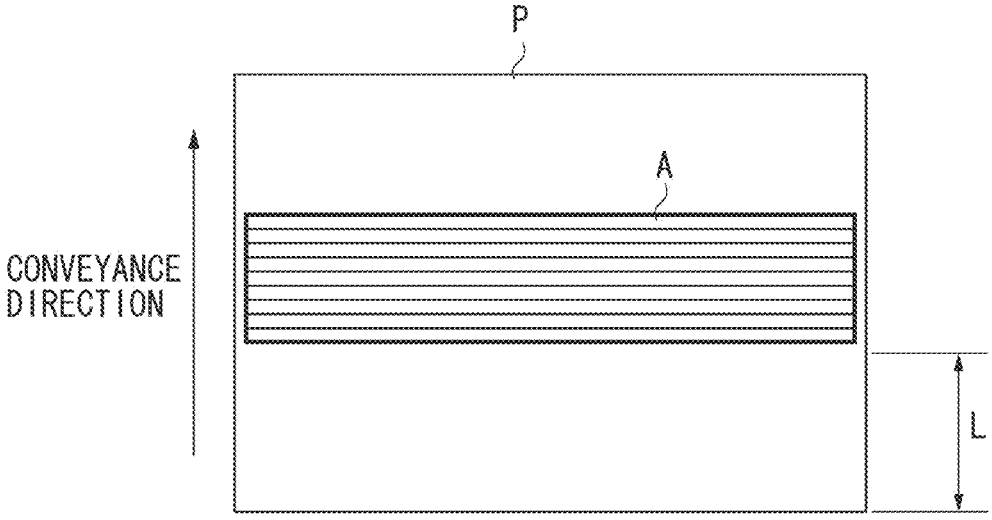
FIG. 11 is a diagram illustrating a test sheet formed by an image forming apparatus according to another exemplary embodiment.

Moreover, a test sheet T may be constituted by forming only an image A in an area located a length L or more away from a tailing edge toward a leading edge side of a recording material P in a conveyance direction of a recording material P of A4 size as illustrated in FIG. 11, instead of forming an image A and an image B. The CPU 120 sets the rotation speed of the motor 70 at the time when a difference between a density of the image A read by the reader unit 1R and a predetermined density is a threshold value or less to a rotation speed to be used when a toner image is formed on a recording material P according to image data input by reading a document or by an external PC. In this configuration, an image B does not need to be formed in an area within a length L from a tailing edge toward a leading edge side of the recording material P in a conveyance direction of the recording material P, thereby saving consumption of toner.

In each of the first and second exemplary embodiments, an image A and an image B are separately formed on one recording material P to form a test sheet T. However, an image A and an image B may be formed as one serial image on one recording material P. Alternatively, an image A and an image B may be formed separately on different recording materials P.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-008206 filed Jan. 18, 2012, which is hereby incorporated by reference herein in its entirety.

What is claimed is:

1. An image forming apparatus comprising:

an image bearing member;

an image forming unit configured to form an image on the image bearing member;

a transfer unit configured to transfer the image formed on the image bearing member to a recording material;

a conveyance unit configured to convey the recording material to the transfer unit;

a conveyance control unit configured to control the conveyance unit such that a conveyance speed in which the recording material is conveyed by the conveyance unit in a period in which the transfer unit transfers the image to the recording material becomes higher than a conveyance speed in which the image on the image bearing member is conveyed in the period;

a measurement unit configured to measure a test image; and a determination unit configured to control the image forming unit to form a test image on the image bearing member, to control the transfer unit to transfer the test image on the image bearing member to the recording material, and to determine a conveyance speed of the recording material conveyed by the conveyance unit based on a result of measurement of the test image on the recording material by the measurement unit.

2. The image forming apparatus according to claim 1, wherein the determination unit is configured to determine the conveyance speed for each sheet type of recording material.

3. The image forming apparatus according to claim 1, wherein the determination unit is configured to determine the conveyance speed so that a density difference between a density of the test image on the recording material and a predetermined density becomes less than a threshold value.

4. The image forming apparatus according to claim 1, wherein the determination unit is configured to control the conveyance unit to convey the recording material at a plurality of conveyance speeds, wherein the measurement unit is configured to measure test images on a plurality of recording materials corresponding to the plurality of conveyance speeds, and wherein the determination unit is configured to determine the conveyance speed based on results of measurement of the test images on the plurality of recording materials by the measurement unit.

5. The image forming apparatus according to claim 4, wherein the determination unit is configured to determine conveyance speeds at which each of density differences between each of densities of the test images on the plurality of the recording materials and a predetermined density is smaller than a threshold value.

6. The image forming apparatus according to claim 5, wherein the determination unit is configured to determines a greatest conveyance speed among a plurality of conveyance speeds at which the density difference is less than the threshold value.

7. The image forming apparatus according to claim 5, wherein the determination unit is configured to determines a conveyance speed at which the density difference is least among a plurality of conveyance speeds at which the density difference is less than the threshold value.

8. The image forming apparatus according to claim 5, wherein the determination unit is configured to determine a lowest conveyance speed among the plurality of conveyance speeds if the density difference is not less than the threshold value.

9. The image forming apparatus according to claim 1, wherein the test image is transferred to an area on a leading edge side located a predetermined length or more away from a tailing edge of the recording material in a direction of conveying the recording material by the conveyance unit.

10. The image forming apparatus according to claim 1, wherein the test image includes a first test image transferred to a first area on a leading edge side located a predetermined length or more away from a tailing edge of the recording material in a direction of conveying the recording material by the conveyance unit, and a second test image transferred to a second area located the predetermined length or less away from the trailing edge of the recording material toward the leading edge side in the direction of conveying the recording material by the conveyance unit.

11. The image forming apparatus according to claim 10, wherein the determination unit is configured to determine the conveyance speed based on a result of measurement of the first test image by the measurement unit and a result of measurement of the second test image by the measurement unit.

12. The image forming apparatus according to claim 1, wherein the conveyance unit is located on the upstream side of the transfer unit in a conveyance path in which the recording material is conveyed by the conveyance unit.

13. An image forming apparatus comprising:

an image bearing member;

an image forming unit configured to form an image on the image bearing member;

a transfer unit configured to transfer the image formed on the image bearing member to a recording material;

a conveyance unit configured to convey the recording material to the transfer unit;

a conveyance control unit configured to control the conveyance unit such that a conveyance speed in which the recording material is conveyed by the conveyance unit in a period in which the transfer unit transfers the image to the recording material becomes higher than a conveyance speed in which the image on the image bearing member is conveyed in the period;

a controller configured to form a plurality of test sheets by controlling the image forming unit to form a test image on the image bearing member, and controlling the transfer unit to transfer the test image on the image bearing member to a plurality of recording materials, wherein, in a case where the controller forms the plurality of the test sheets, the conveyance control unit controls the conveyance unit such that a plurality of conveyance speeds in which the plurality of recording materials are conveyed by the conveyance unit are different from each other;

an obtaining unit configured to obtain information indicating a test sheet selected by a user among from the plurality of test sheets; and a determination unit configured to determine the conveyance speed that corresponds to the information obtained by the obtaining unit.

14. The image forming apparatus according to claim 13, wherein the test image is transferred to an area on a leading edge side located a predetermined length or more away from a tailing edge of the recording material in a direction of conveying the recording material by the conveyance unit.

15. The image forming apparatus according to claim 13, wherein the test image includes a first test image transferred to a first area on a leading edge side located a predetermined length or more away from a tailing edge of the recording material in a direction of conveying the recording material by the conveyance unit, and a second test image transferred to a second area located the predetermined length or less away from the trailing edge of the recording material toward the leading edge side in the direction of conveying the recording material by the conveyance unit.

16. The image forming apparatus according to claim 13, wherein the conveyance unit is located on the upstream side of the transfer unit in a conveyance path in which the recording material is conveyed by the conveyance unit.

* * * * *